US005657709A

United States Patent [19]

Miyachi et al.

[11] Patent Number: 5,657,709

[45] Date of Patent: Aug. 19, 1997

[54] TAPE WASTE COLLECTOR ASSEMBLY FOR USE WITH A BELT LOOP SEWING MACHINE

[75] Inventors: Kouji Miyachi, Kyoto; Ryoichi Kazuno, Otsu, both of Japan

[73] Assignee: Hams Corporation, Kyoto, Japan

[21] Appl. No.: 511,891

[22] Filed: Aug. 7, 1995

[30] Foreign Application Priority Data

Aug. 11, 1994 [JP] Japan ..... 6-222355
Aug. 20, 1994 [JP] Japan ..... 6-230141

[51] Int. Cl.[6] ..... D05B 35/06; D05B 37/04; D05B 81/00

[52] U.S. Cl. ..... 112/282; 112/287

[58] Field of Search ..... 112/282, 287, 112/300, 122, 130, 470.33, 470.34, 470.05, 470.36, DIG. 1, DIG. 3; 83/99, 100

[56] References Cited

U.S. PATENT DOCUMENTS

| | | | |
|---|---|---|---|
| 395,549 | 1/1889 | Cornely | 112/282 X |
| 2,827,867 | 3/1958 | Happe . | |
| 3,799,088 | 3/1974 | Marforio . | |
| 3,800,717 | 4/1974 | Olday . | |
| 4,114,544 | 9/1978 | Miyachi et al. . | |
| 4,127,075 | 11/1978 | Adamski, Jr. et al. . | |
| 4,632,047 | 12/1986 | Seaman . | |
| 4,709,645 | 12/1987 | Jones et al. . | |
| 4,764,058 | 8/1988 | Jones et al. | 112/282 X |
| 4,895,088 | 1/1990 | Pirrello et al. | 112/130 |

FOREIGN PATENT DOCUMENTS

| | | |
|---|---|---|
| 1231198 | 12/1966 | Germany . |
| 6315583 | 11/1994 | Japan . |
| 560273 | 3/1975 | Switzerland . |

*Primary Examiner*—Peter Nerbun
*Attorney, Agent, or Firm*—Greenblum & Bernstein P.L.C.

[57] ABSTRACT

A tape waste collector assembly is suited for use with a belt loop sewing machine having a tape cutter for cutting a length of tape placed on a tape receiving plate into pieces of a predetermined length so that each of the pieces of tape may be sewn on a garment to form a belt loop. The tape waste collector assembly includes an air source, one or more air pipes pneumatically connected to the air source for blowing compressed air supplied from the air source towards the length of tape placed on the tape receiving plate, and a plurality of tape waste collecting elements such as, for example, a hose, a waste box and the like for collecting tape wastes produced when the length of tape is cut by the tape cutter. A controller controls a plurality of solenoid valves to operate the air pipes and the plurality of tape waste collecting elements so that the tape wastes blown off by the air pipes are appropriately collected by the plurality of tape waste collecting elements.

20 Claims, 12 Drawing Sheets

TAPE WASTE COLLECTOR ASSEMBLY FOR USE WITH A BELT LOOP SEWING MACHINE

BACKGROUND OF THE INVENTION

1. Field of the Invention

The present invention relates generally to a tape waste collector assembly for use with a belt loop sewing machine and, more particularly, to a tape waste collector assembly for collecting cutting wastes produced when a length of tape is cut into pieces for formation of belt loops.

2. Description of Related Art

FIGS. 14 and 15 depict a sewing machine M dedicated for use in sewing belt loops on a garment such as, for example, pants, jeans or the like. This sewing machine M is provided with a tape feed platform 10 for feeding a length of tape T, a tape cutter 12 disposed at a downstream end of the tape feed platform 10 with respect to a direction of travel of the tape T, a tape receiving plate 15 disposed downstream of the tape cutter 12, and a conventional seam discharging mechanism 25 disposed above the tape receiving plate 15. The seam discharging mechanism 25 comprises a horizontally and vertically movable compression coil spring 27 for pressing the tape T. The tape cutter 12 is intended to cut the tape T into pieces of a predetermined length for use as belt loops, and is also intended to cut a rear portion of a seam S so that a piece T1 of tape having the seam S and cut by the tape cutter 12 may be discharged into a waste box 28 located in front of a machine table 32 below the tape receiving plate 15. To this end, the piece T1 of tape having the seam S, retained on the tape receiving plate 15 by the compression coil spring 27, is dropped straight down into the waste box 28 by horizontally moving the compression coil spring 27 relative to the tape receiving plate 15 in a direction generally perpendicular to the direction of travel of the tape T, as shown by a single-dotted chain line in FIG. 15.

As shown in FIGS. 14 and 15, when the sewing machine M is used to sew belt loops on trousers, a waist part G of the trousers is first placed on a sewing plate 36 so that a belt loop may be sewn thereon. When an operator subsequently moves the waist part G to a next belt loop position in a direction shown by an arrow B using his right and left hands, the piece T1 of tape impinges on his right hand, with the result that the piece T1 of tape falls on the floor of a working place without entering the waste box 28 located below the tape receiving plate 15. Therefore, the operator is obliged to collect a large number of pieces T1 of tape scattering on the floor after his work is finished.

Furthermore, when opposite ends of each belt loop are cut generally in the shape of "X", triangular wastes R and L are inevitably separated therefrom, as shown in FIG. 16. The waste box 28 referred to above is also used to collect these triangular wastes R and L.

However, the waste box 28 cannot collect all the triangular wastes R and L, and part of the triangular wastes R and L scatters on respective sides of the tape cutter 12 and fails on the sewing plate 36 or the machine table 32. Accordingly, the operator is obliged to collect a large number of triangular wastes R and L scattering on the sewing plate 36 or the machine table 32 as well as the pieces T1 of tape scattering on the floor.

Since an opening 29 of the waste box 28 is extended nearly immediately below a machine bed 35 so as to positively collect the cutting wastes referred to above, a portion of the lower part of the operator such as, for example, legs or knees is brought into contact with the waste box 28 when the sewing machine is in operation, thus annoying the operator.

SUMMARY OF THE INVENTION

The present invention has been developed to overcome the above-described disadvantages.

It is accordingly an objective of the present invention to provide a tape waste collector assembly capable of positively collecting all of cutting wastes produced when a length of tape is cut into pieces for formation of belt loops or when opposite ends of each belt loop are cut generally in the shape of "X".

Another objective of the present invention is to provide the tape waste collector assembly of the above-described type which is not brought into contact with any portion of an operator operating a sewing machine and, hence, does not hinder him in his operation.

In accomplishing the above and other objectives, the tape waste collector assembly of the present invention comprises an air source, an air blow means pneumatically connected to the air source for blowing compressed air supplied from the air source towards a length of tape placed on a tape receiving means, a tape waste collecting means for collecting tape wastes produced when the length of tape is cut by a cutting means mounted in the sewing machine, and a control means for controlling the air blow means and the tape waste collecting means so that the tape wastes blown off by the air blow means are collected by the tape waste collecting means.

Advantageously, the air blow means comprises an air pipe disposed downstream of the cutting means with respect to a direction of travel of the tape for blowing off a piece of tape having a seam.

Again advantageously, the tape waste collecting means comprises a hose having opposite first and second ends with the first end disposed downstream of the cutting means with respect to the direction of travel of the tape, a waste box connected to the second end of the hose, and a negative pressure generating means for generating a negative pressure inside the hose to introduce the tape wastes into the hose and then into the waste box.

Conveniently, the negative pressure generating means comprises a Venturi tube mounted on an intermediate portion of the hose and pnenmatically connected to the air source.

Alternatively, the air blow means comprises at least one air pipe disposed in the proximity of the cutting means for blowing off tape wastes produced when the length of tape is cut in the shape of "X" by the cutting means.

In this case, it is preferred that the tape waste collecting means comprises a hopper disposed below the cutting means, a hose having opposite first and second ends with the first end connected to the hopper, a waste box connected to the second end of the hose, and a negative pressure generating means for generating a negative pressure inside the hose to introduce the tape wastes into the hose and then into the waste box.

The air blow means may comprise two air pipes disposed upstream and downstream of the cutting means with respect to the direction of travel of the tape, respectively, for blowing off, on respective sides of the cutting means, associated tape wastes produced when the length of tape is cut in the shape of "X" by the cutting means.

BRIEF DESCRIPTION OF THE DRAWINGS

The above and other objectives and features of the present invention will become more apparent from the following description of a preferred embodiment thereof with reference to the accompanying drawings, throughout which like parts are designated by like reference numerals, and wherein.

DETAILED DESCRIPTION OF THE PREFERRED EMBODIMENTS

Figure 1:
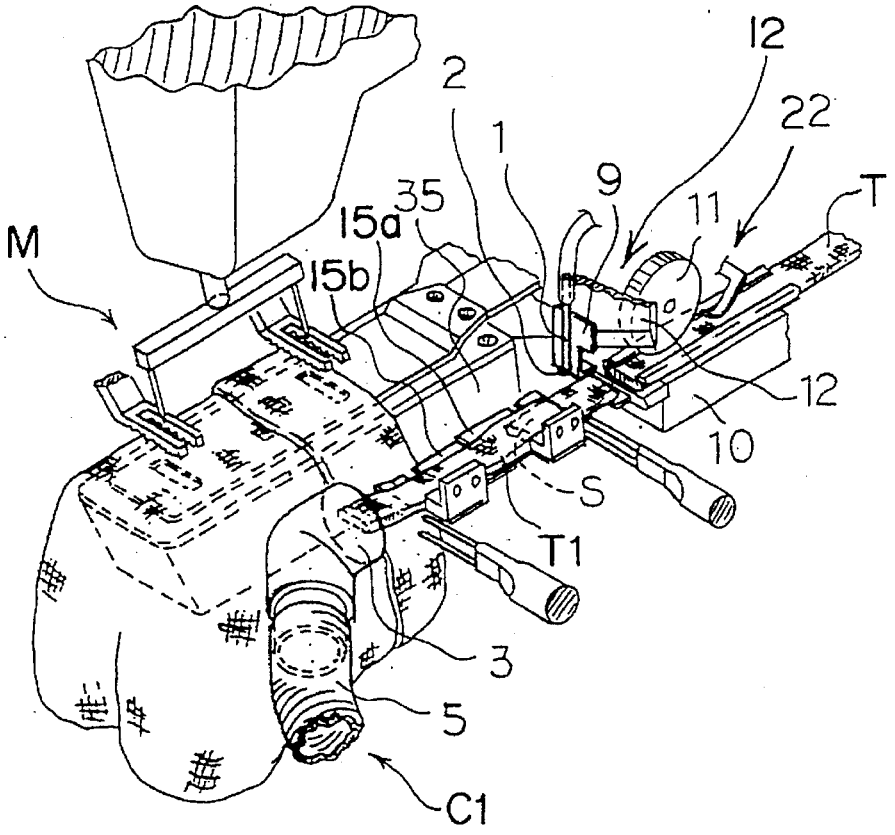
FIG. 1 is a fragmentary perspective view of a sewing machine provided with a first tape waste collector of the present invention.

Referring now to the drawings, there is shown in FIG. 1 a sewing machine M provided with a tape waste collector assembly embodying the present invention.

The sewing machine M includes a machine bed 35 on which a garment such as, for example, pants, jeans or the like is placed, a tape feed platform 10 disposed obliquely upwardly of the machine bed 35 to place thereon a length of tape T having a plurality of seams S, a tape feed roller 11 disposed above the tape feed platform 10 for feeding the tape T along the tape feed platform 10, a seam detecting mechanism 22 for detecting the seams S of the tape T, and a tape cutter 12 for cutting the tape T into pieces of a predetermined length for use as belt loops. The seam detecting mechanism 22 and the tape cutter 12 are disposed upstream and downstream of the tape feed roller 11 with respect to a direction of travel of the tape T. The tape cutter 12 is horizontally pivotally mounted on the tape feed platform 10 and is made up of a vertically movable blade 12*a* and a stationary blade 12*b*.

A pair of elongated tape receiving plates 15*a* and 15*b* are disposed downstream of the tape feed platform 10 in an overlapping relationship and are aligned with each other with respect to the direction of travel of the tape T. An L-shaped guide plate. 9 is disposed above an upstream end of the upstream tape receiving plate 15*a* for preventing the leading end of the tape T from being raised upwardly.

The tape waste collector assembly of the present invention comprises a first tape waste collector C1 for collecting pieces T1 of tape having a seam S and a second tape waste collector C2 for collecting triangular wastes R and L produced when opposite ends of each belt loop is cut in the shape of "X".

Figure 2:
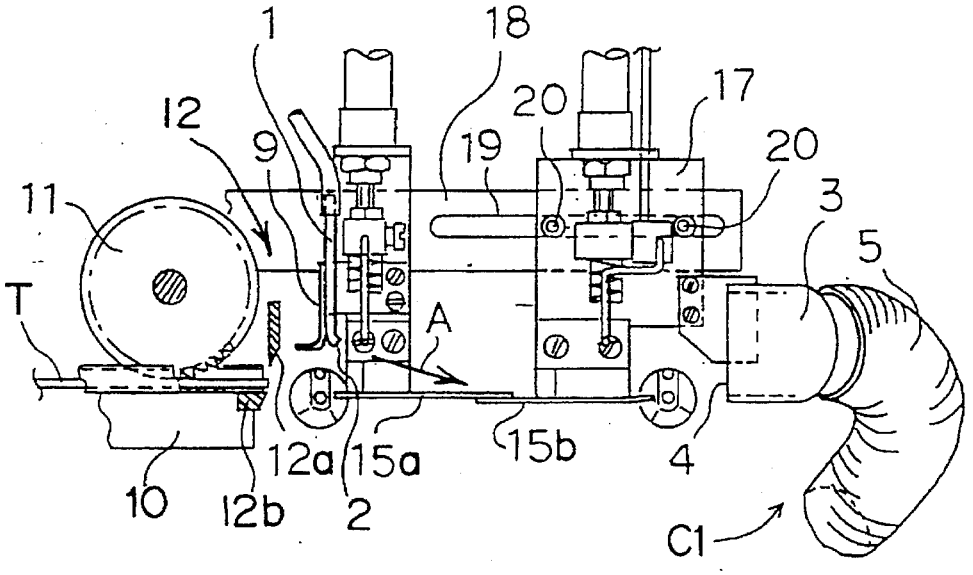
FIG. 2 is a fragmentary elevational view of the sewing machine of FIG. 1.
Figure 3:
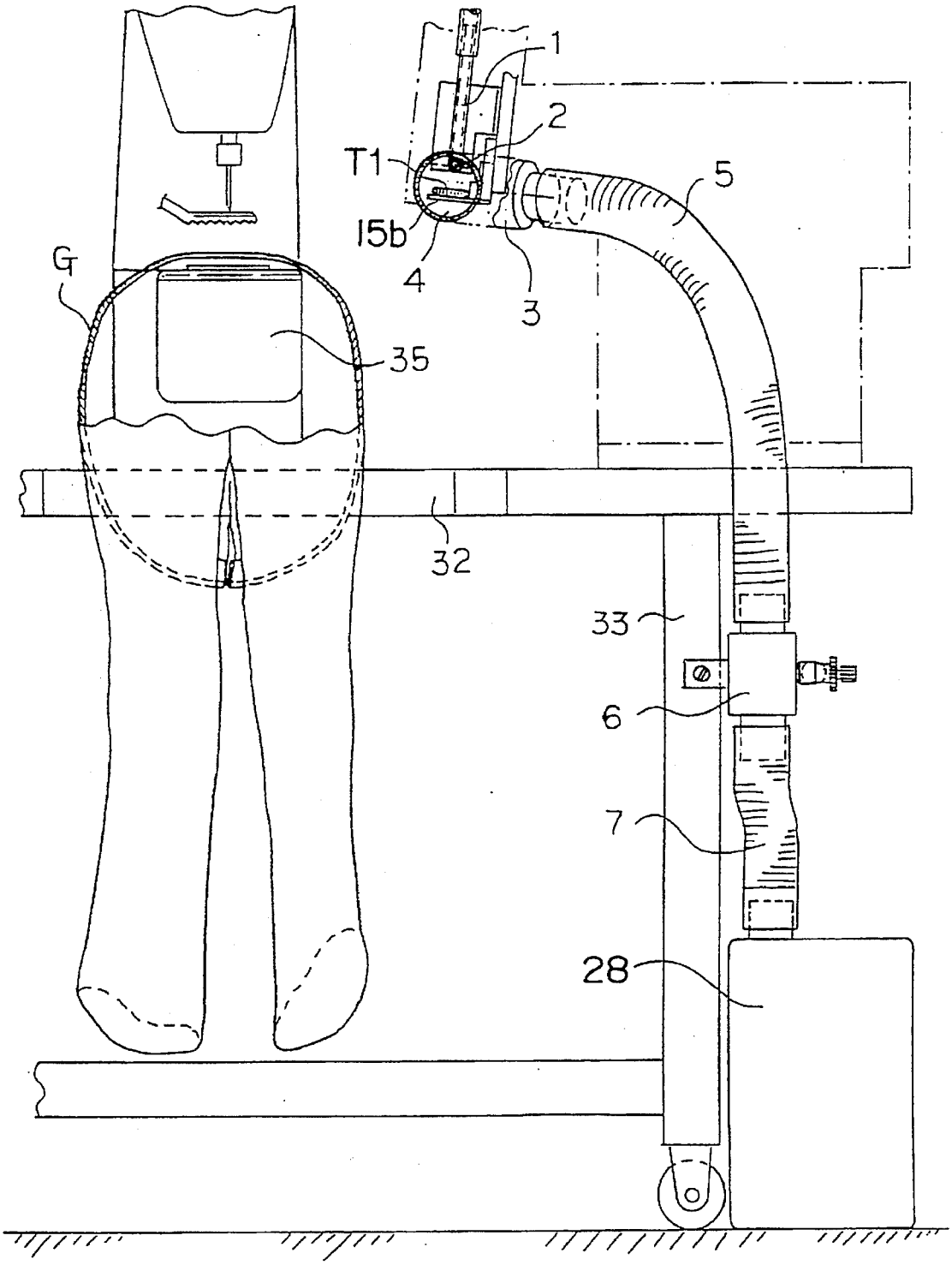
FIG. 3 is an elevational view of the first tape waste collector.

The first tape waste collector C1 comprises an air pipe 1 having an air nozzle 2 and mounted on a vertically extending front face of the guide plate 9, with the air nozzle 2 directed so as to blow compressed air towards an upper surface of at least the upstream tape receiving plate 15*a* in the direction of travel of the tape T, i.e. in the direction shown by an arrow A in FIG. 2.

A pipe-like suction cap 3 is disposed downstream of the downstream tape receiving plate 15*b* and has a suction port 4 confronting a downstream end thereof so as to suck pieces T1 of tape with a seam S, as shown in FIG. 1. The suction cap 3 is bent approximately 45° in a direction away from the sewing machine M. As clearly shown in FIG. 2, the suction cap 3 is secured to a front or downstream end of a movable vertical plate 17 having a lower end from which the downstream tape receiving plate 15*b* projects in the manner of a cantilever.

The suction cap 3 is connected to a downwardly bent bellows hose 5, which is in turn connected at its lower end to a suction port of a Venturi tube 6 secured to a leg 33 of a machine table 32. A discharge port of the Venturi tube 6 is connected to an upper end of another bellows hose 7, a lower end of which is connected to a waste box 28 located in the proximity of the leg 33 so as not to hinder an operator in his operation.

The movable vertical plate 17 to which the suction cap 3 is secured is mounted, by screws 20, on a holding rail 18 extending generally parallel to the direction of travel of the tape T. Because the screws 20 are received in a horizontally extending elongated opening 19 defined in the holding rail 18, the position of the vertical plate 17 can be readily adjusted by loosening the screws 20. If the length of the pieces of tape used for forming belt loops is to be changed, the position of the downstream tape receiving plate 15*b* relative to the upstream tape receiving plate 15*a* is adjusted according to the length of the pieces of tape by horizontally moving the vertical plate 17.

It is to be noted here that although in the above-described embodiment the downstream tape receiving plate 15*b* is designed so as to comply with any length of the pieces of tape, if the length of the pieces of tape is made constant, the use of a single stationary plate is preferred and no adjustable two-ply structure is required.

Figure 4:
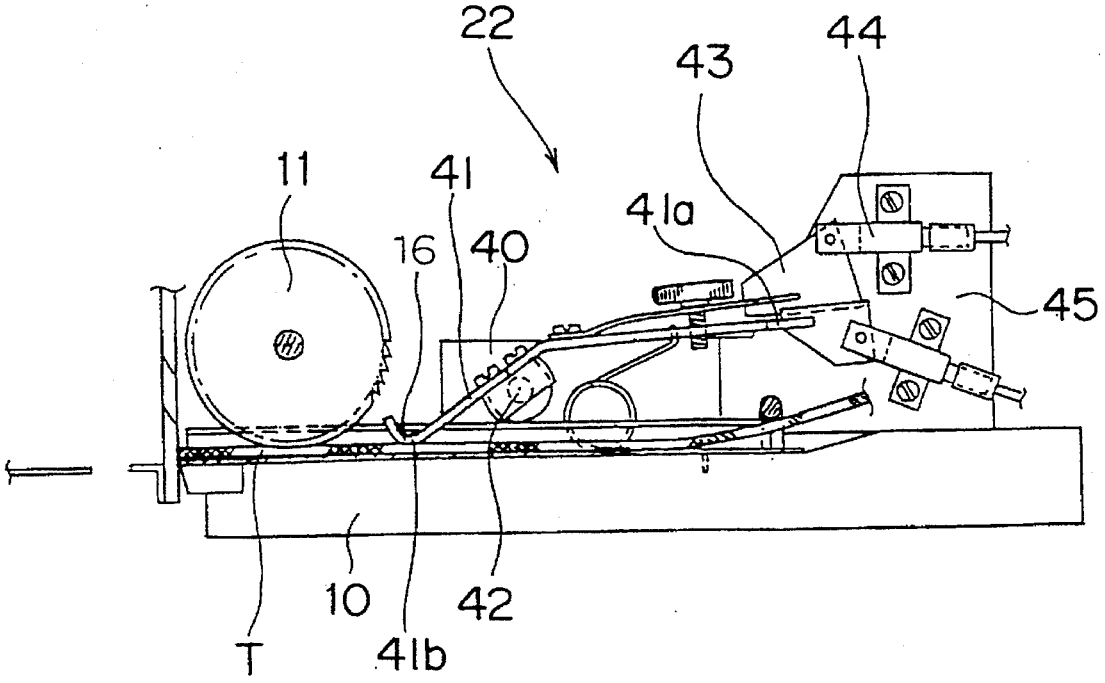
FIG. 4 is an elevational view of a seam detecting mechanism mounted in the sewing machine of FIG. 1.

FIG. 4 depicts the seam detecting mechanism 22 referred to above, which comprises a bearing 40 secured to the tape feed platform 10, an arm 41 pivotally mounted on the bearing 40 via a shaft 42, a shielding plate 43 secured to an upstream end 41*a* of the arm 41, and a photoelectric switch 44 mounted on a vertical plate 45 secured to the tape feed platform 10.

The arm 41 is biased by a spring so that a downstream end 41*b* thereof is held in contact with the upper surface of the tape T. The photoelectric switch 44 is normally switched off by the shielding plate 43. However, when a seam S having a thickness greater than that of the tape T reaches the location of the downstream end 41*b* of the arm 41, the latter is moved slightly upwardly by the former, while the upstream end 41*a* of the arm 41 is moved slightly downwardly together with the shielding plate 43, thereby switching on the photo-electric switch 44.

Details of the seam detecting mechanism 22 are disclosed in Japanese Laid-open Patent Publication (unexamined) No. 6-315583, which is expressly incorporated by reference herein.

Figure 5:
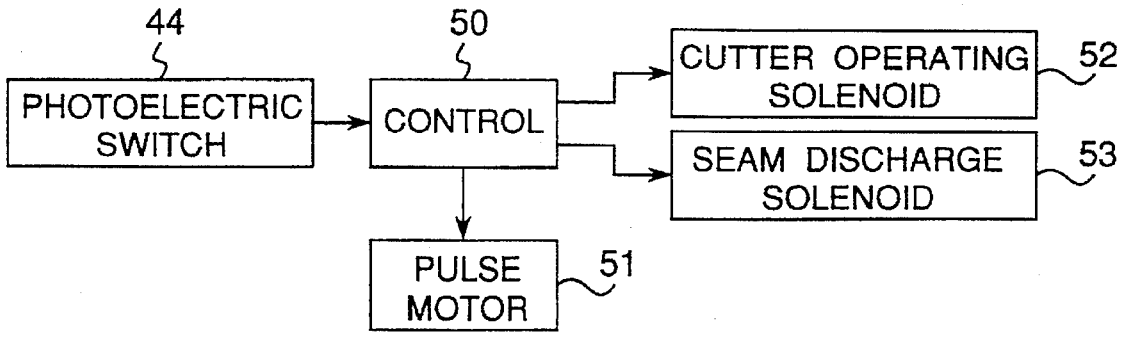
FIG. 5 is a block diagram of a control system for controlling the sewing machine and the first tape waste collector.

FIG. 5 depicts a control system for controlling the sewing machine M and the first tape waste collector C1. As shown therein, the control system comprises a controller 50 having a microcomputer, the photoelectric switch 44 referred to above, a pulse motor 51 drivingly connected to the tape feed roller 11 via a drive-force transmission means such as, for example, a chain, a solenoid valve 52 for vertically moving the movable blade 12*a* of the tape cutter 12, and another solenoid valve 53 for discharging the pieces T1 of tape with a seam S into the waste box 28. All of the photoelectric switch 44, the pulse motor 51 and the two solenoid valves 52 and 53 are operatively connected with the controller 50.

Figure 6:
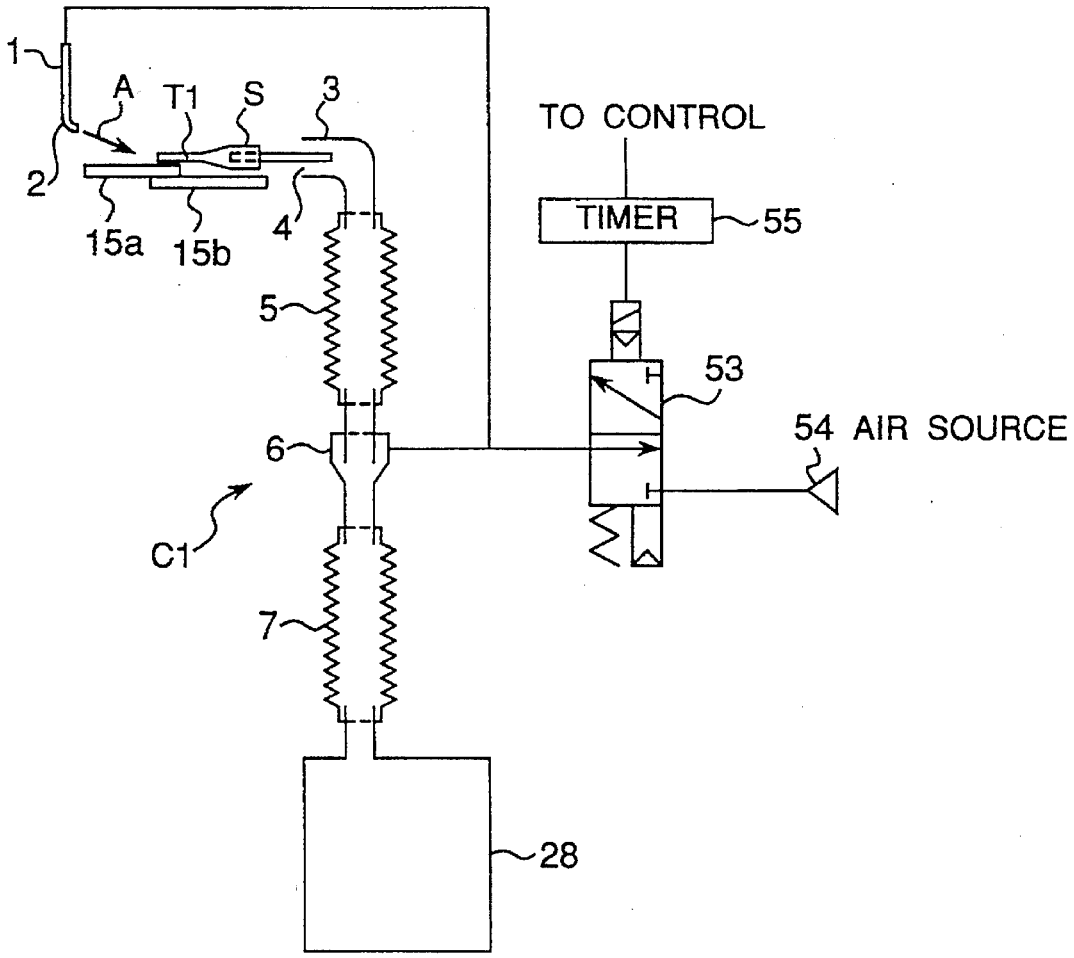
FIG. 6 is a schematic diagram of the first tape waste collector.

As shown in FIG. 6 indicating an air piping diagram of the first tape waste collector C1, both of the air pipe 1 and the Venturi tube 6 are pneumatically connected to the solenoid valve 53, which is in turn pneumatically connected to an air source 54 so that the pieces of tape with a seam S may be appropriately introduced into the waste box 28.

Figure 7:
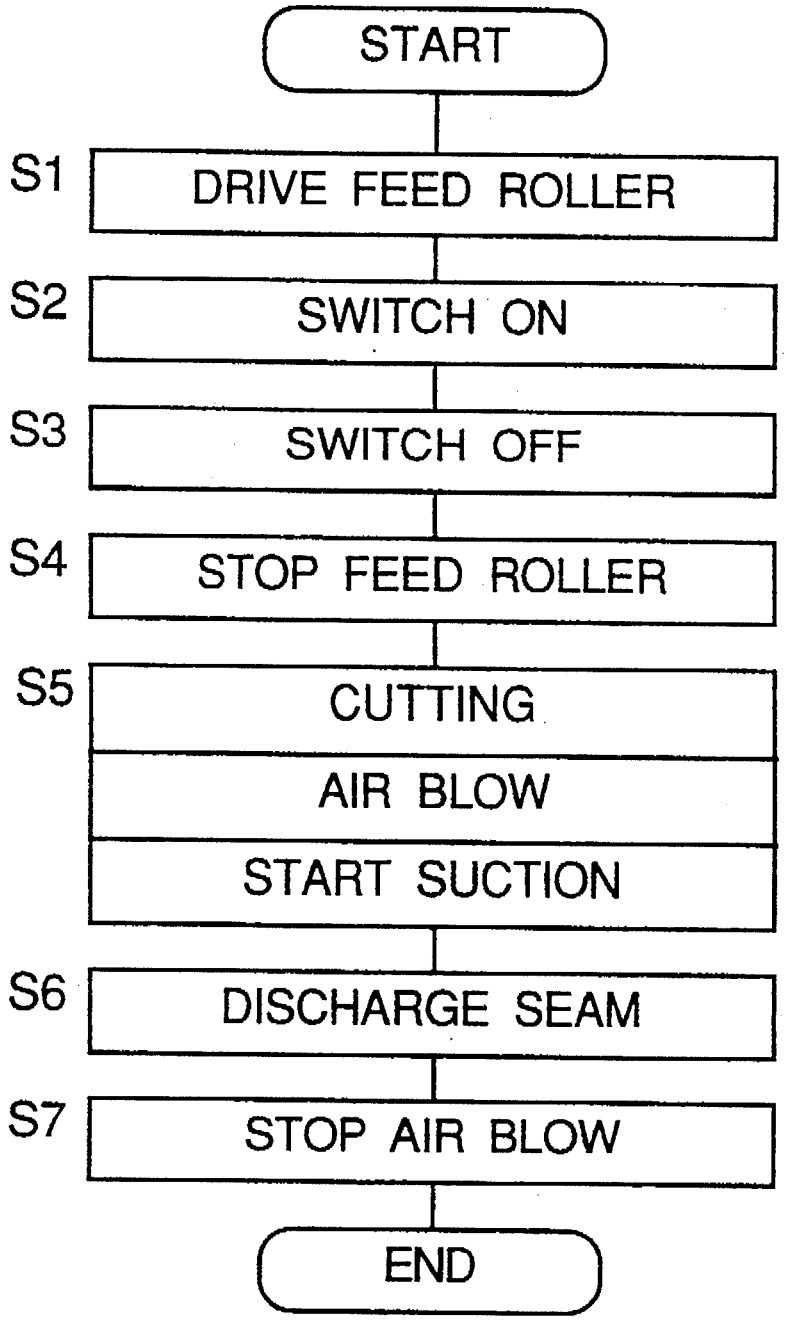
FIG. 7 is a flow-chart indicating the operation of the first tape waste collector.

The operation of the first tape waste collector C1 is explained in detail hereinafter with reference to a flow-chart shown in FIG. 7.

At step S1, the pulse motor 51 is activated to rotate the tape feed roller 11 so as to feed a length of tape T, which is in turn cut by the tape cutter 12 into pieces of a predetermined length for use as belt loops.

During feeding, when a seam S reaches the downstream end 41*b* of the arm 41, the former moves the latter upwardly and, also, moves the upstream end 41*a* of the arm 41 together with the shielding plate 43 downwardly, thereby switching on the photoelectric switch 44 (step S2). At this time, the photoelectric switch 44 generates and sends a seam detection signal to the controller 50 so that the tape feed roller 11 may feed the tape T with the seam S onto the tape receiving plates 15*a* and 15*b*, as shown in FIG. 1.

When the seam S is completely fed, the shielding plate 43 is moved upwardly and switches off the photoelectric switch 44 (step S3). Then, the controller 50 controls the pulse motor 51 so that the tape feed roller 11 further feeds the tape T by a predetermined length and is subsequently stopped (step S4).

When the tape feed roller 11 is stopped, the controller 50 controls the solenoid valve 52 to move the movable blade 12*a* downwardly so as to cut the tape T at a location approximately 10 mm rearward from a trailing end of the seam S. At this time, the controller 50 also controls the solenoid valve 53 to blow compressed air from the air nozzle 2 of the air pipe 1 in the direction of the arrow A in FIG. 2 so that a piece T1 of tape with the seam S on the tape receiving plates 15*a* and 15*b* may be introduced into the suction port 4 of the suction cap 3 (step S5).

Furthermore, because the compressed air is also introduced into the Venturi tube 6, the inside of the bellows hose 5 has a negative pressure and, hence, the piece T1 of tape with the seam S is sucked into it. The piece T1 of tape then passes through the Venturi tube 6 and bellows hose 7 and is positively discharged into the waste box 28 connected to the bellows hose 7 (step S6).

When a timer 55 electrically connected to the solenoid valve 53 is up, the solenoid valve 53 is deenergized to stop blowing the compressed air (step S7).

The steps S1 to S7 above are automatically repeated whenever the controller 50 receives a seam detection signal from the photoelectric switch 44 of the seam detecting mechanism 22.

As described hereinabove, because pieces Ti of tape with a seam S are positively collected in the waste box 28 by making use of the compressed air, no pieces of tape scatter on the floor, thus eliminating sweeping which has hitherto been required upon completion of the sewing operation of belt loops.

Moreover, because all the elements constituting the first tape waste collector C1 are located so as not to hinder the operator in his sewing operation, the operator can devote himself to the sewing operation.

Figure 8:
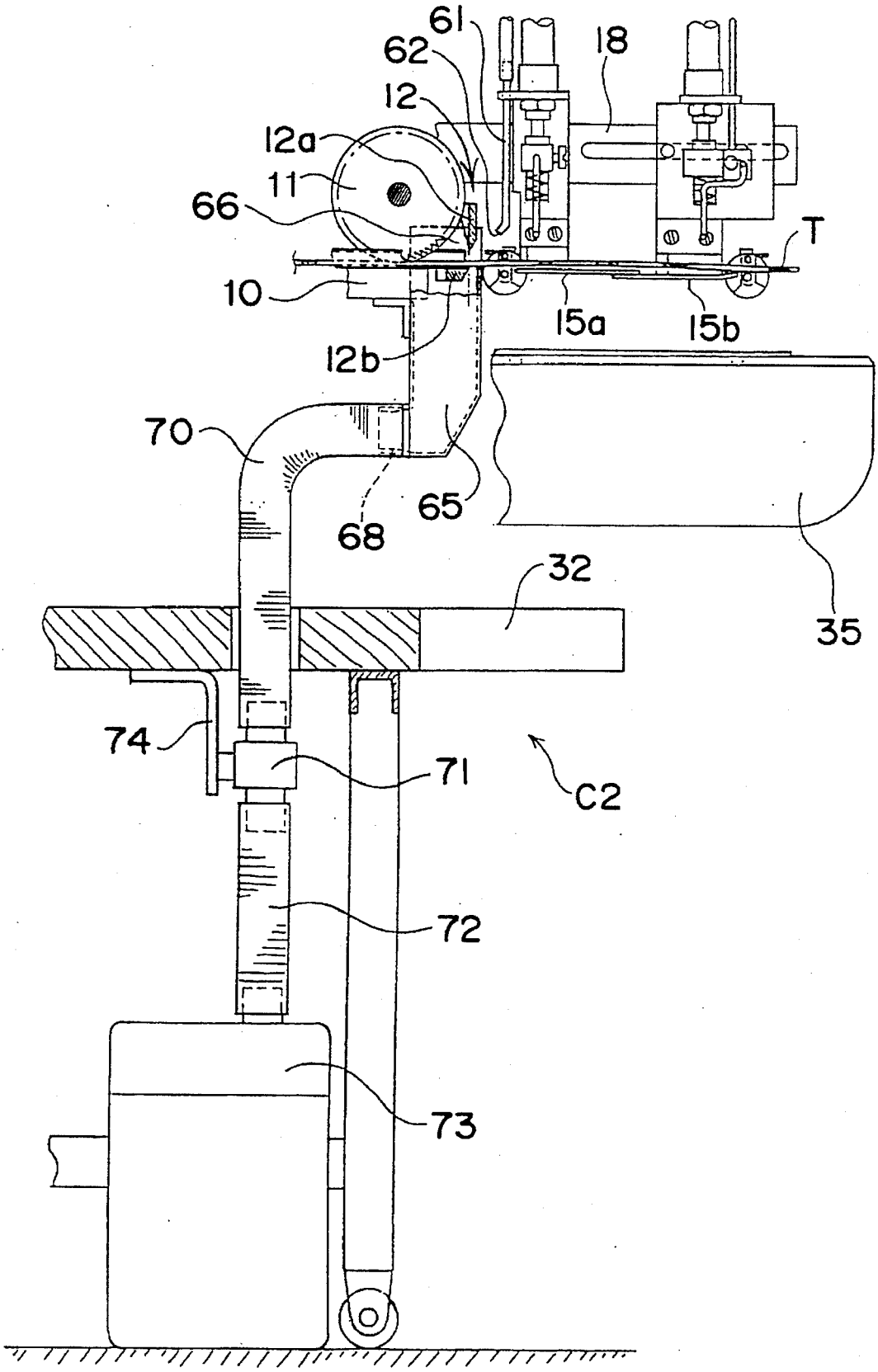
FIG. 8 is an elevational view of a second tape waste collector of the present invention.
Figure 9:
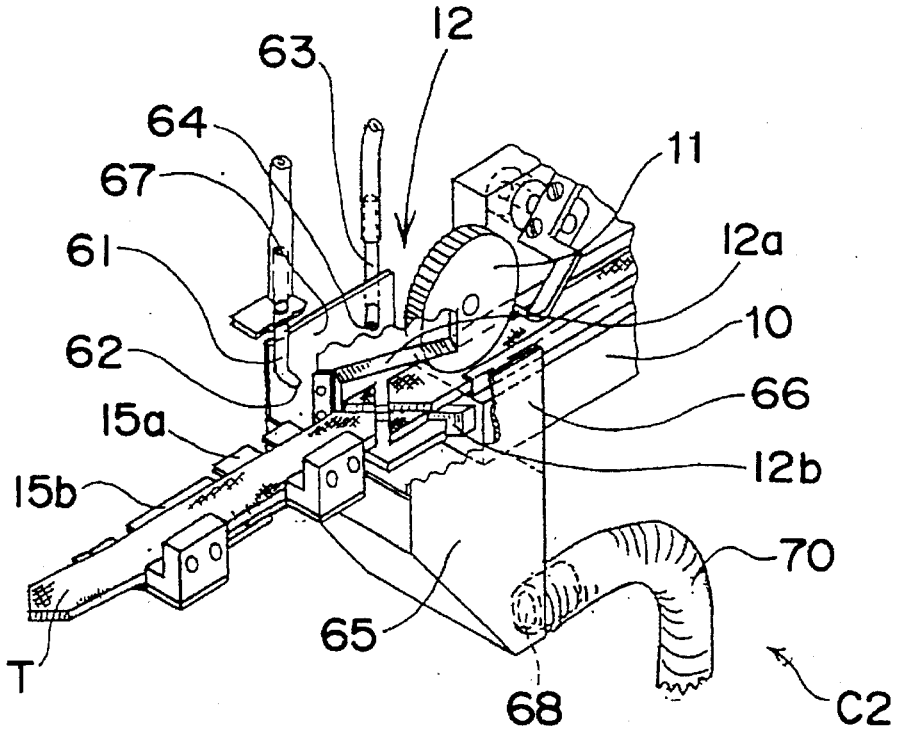
FIG. 9 is a fragmentary perspective view of an upper portion of the second tape waste collector.
Figure 10:
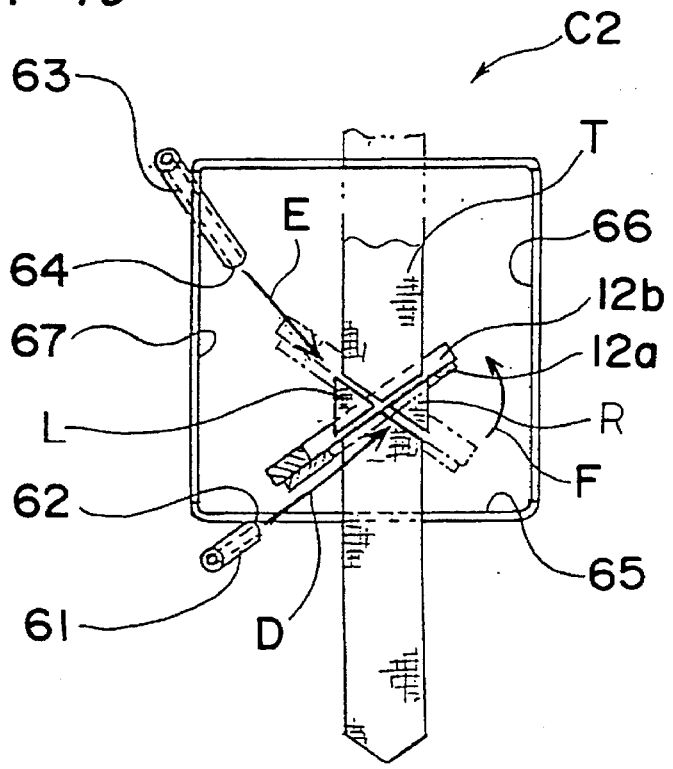
FIG. 10 is a top plan view of the upper portion of the second tape waste collector of FIG. 9.

FIGS. 8 and 9 depict the second tape waste collector C2 for use in collecting triangular cutting wastes R and L produced when opposite ends of a piece of tape of a predetermined length is cut in the shape of "X", as shown in FIG. 10.

To cut the tape T in the shape of "X", the tape cutter 12 having the movable blade 12*a* and the stationary blade 12*b* is allowed to horizontally pivot approximately 55°.

The second tape waste collector C2 comprises a vertically extending air pipe 61 secured to the holding rail 18 at a location downstream of the tape feed roller 11 with respect to the direction of travel of the tape T. The air pipe 61 has an air nozzle 62 directed to blow compressed air towards the right half of the tape T, as shown by an arrow D in FIG. 10, generally in parallel to the stationary blade 12*b* when a second cutting subsequent to a first cutting is being carried out.

Accordingly, as viewed in FIG. 10, the triangular cutting waste R separated from the tape T on the right-hand side thereof is blown towards the right-hand side of the stationary blade 12*b* by the action of the compressed air from the air nozzle 62.

Another vertically extending air pipe 63 is provided slightly upstream of the tape cutter 12 on the left-hand side thereof. The air pipe 63 has an air nozzle 64 directed to blow compressed air towards the left half of the movable blade 12*a* in a direction generally perpendicular thereto, as shown by an arrow E in FIG. 10, when the second cutting is being carried out. Because the compressed air from the air nozzle 64 impinges on and is reflected by the movable blade 12*a*, the left-hand side cutting waste L is blown off leftwardly of the stationary blade 12*b*.

A hopper 65 is disposed below the tape cutter 12 to receive the triangular cutting wastes R and L, as shown in FIGS. 8 and 9. The hopper 65 is secured to a lower end portion of the tape feed platform 10 and has guide plates 66 and 67 extending upwardly therefrom so as to cover respective sides of the tape cutter 12.

Accordingly, when the cutting wastes R and L of the tape T are produced as a result of a sequence of the first cutting, the horizontal pivoting motion of the tape cutter 12 (arrow F in FIG. 10), and the second cutting, and are blown off to the right-hand and left-hand sides of the stationary blade 12*b* by the action of the compressed air from the air nozzles 62 and 64, respectively, the cutting wastes R and L impinge on the guide plates 66 and 67 to be positively introduced into the hopper 65.

As shown in FIGS. 8 and 9, the hopper 65 has a pipe-like boss 68 secured to a lower end thereof and extending upstream thereof. The pipe-like boss 68 is connected to a bellows hose 70 extending upstream thereof and then bent downwardly at a location below an upstream portion of the tape feed platform 10. The bellows hose 70 extends through the machine table 32 and is connected at its lower end to a suction port of a Venturi tube 71, which is secured to a lower surface of the machine table 32 via a bracket 74.

A discharge port of the Venturi tube 71 is connected to another bellows hose 72 which is in turn connected at its lower end to a waste box 73 located below the machine table 32.

Figure 11:
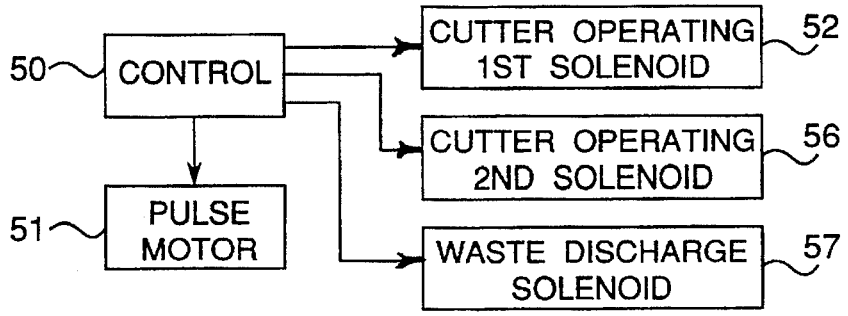
FIG. 11 is a diagram similar to FIG. 5, but indicating a control system for controlling the sewing machine and the second tape waste collector.

FIG. 11 depicts a control system for controlling the sewing machine M and the second tape waste collector C2. As shown therein, the control system comprises a controller 50 having a microcomputer, a pulse motor 51 drivingly connected to the tape feed roller 11 via a drive force transmission means such as, for example, a chain, a first cutter operating solenoid valve 52 for vertically moving the movable blade 12*a* of the tape cutter 12, and a second cutter operating solenoid valve 56 for horizontally pivoting the tape cutter 12, and a waste discharge solenoid valve 57 for discharging the triangular cutting wastes R and L into the waste box 73. All of the pulse motor 51 and the three solenoid valves 52, 56 and 57 are operatively connected with the controller 50.

Figure 12:
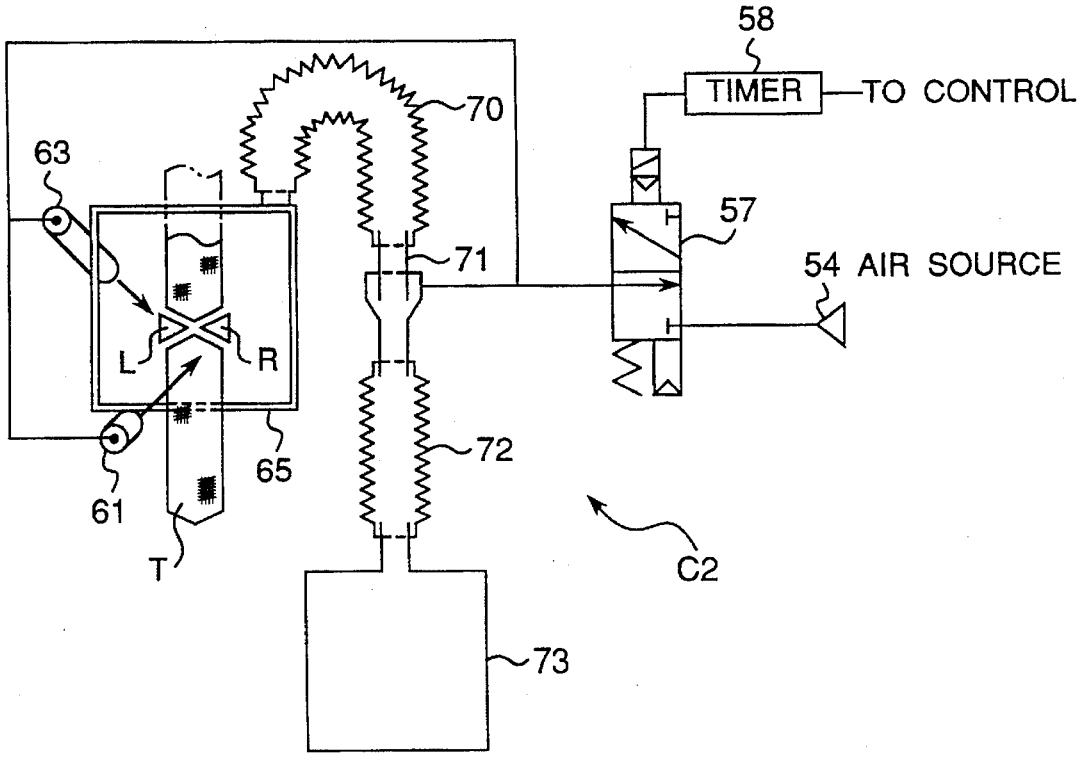
FIG. 12 is a diagram similar to FIG. 6, but indicating the second tape waste collector.

As shown in FIG. 12 indicating an air piping diagram of the second tape waste collector C2, the two air pipes 61 and 63 and the Venturi tube 71 are pneumatically connected to the waste discharge solenoid valve 57, which is in turn pneumatically connected to an air source 54 so that the triangular cutting wastes R and L may be appropriately introduced into the waste box 73.

Figure 13:
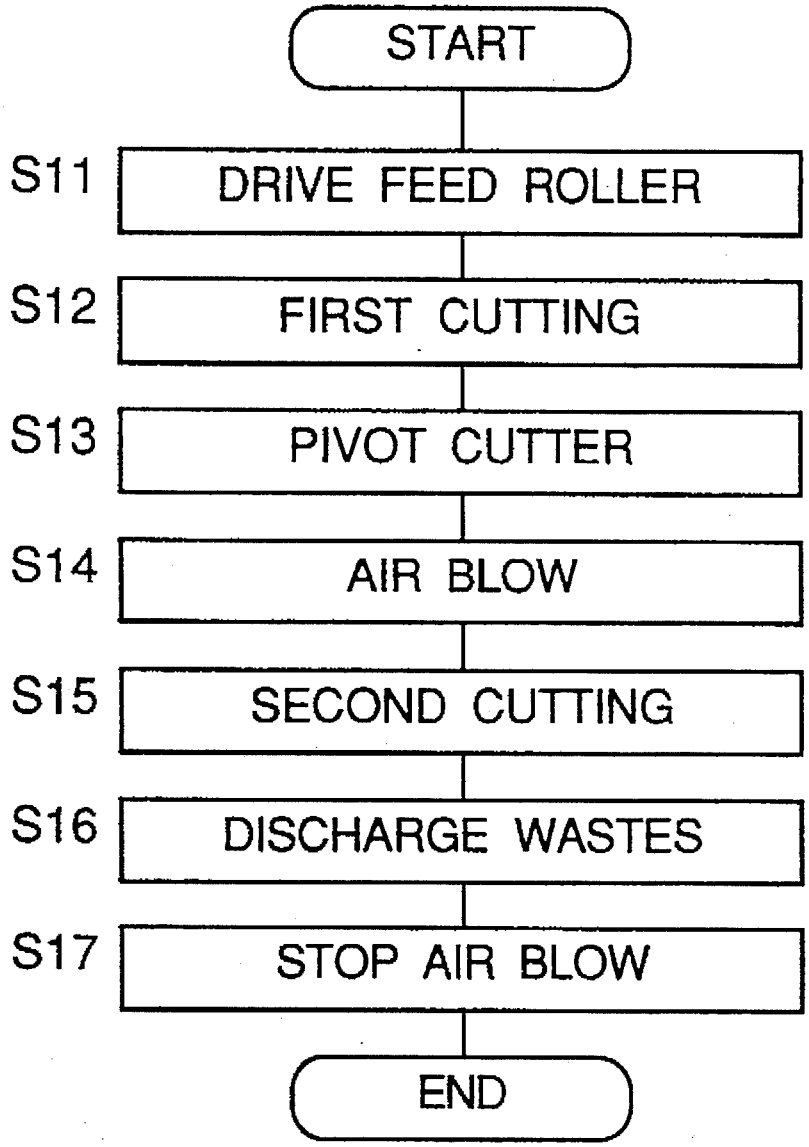
FIG. 13 is a flow-chart indicating the operation of the second tape waste collector.
Figure 14:
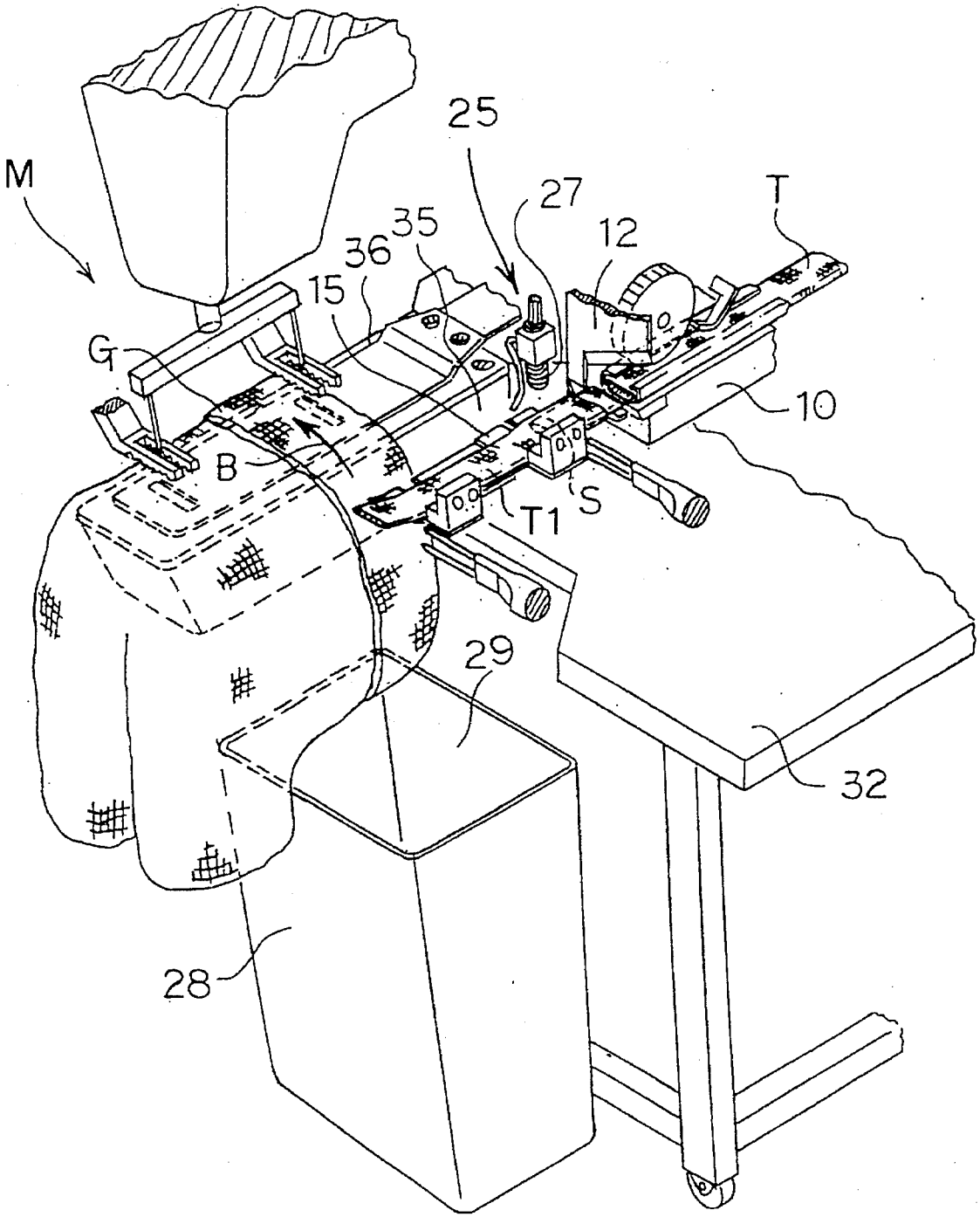
Fig. 14 PRIOR ART
FIG. 14 is a fragmentary perspective view of a sewing machine provided with a conventional seam discharging mechanism.
Figure 15:
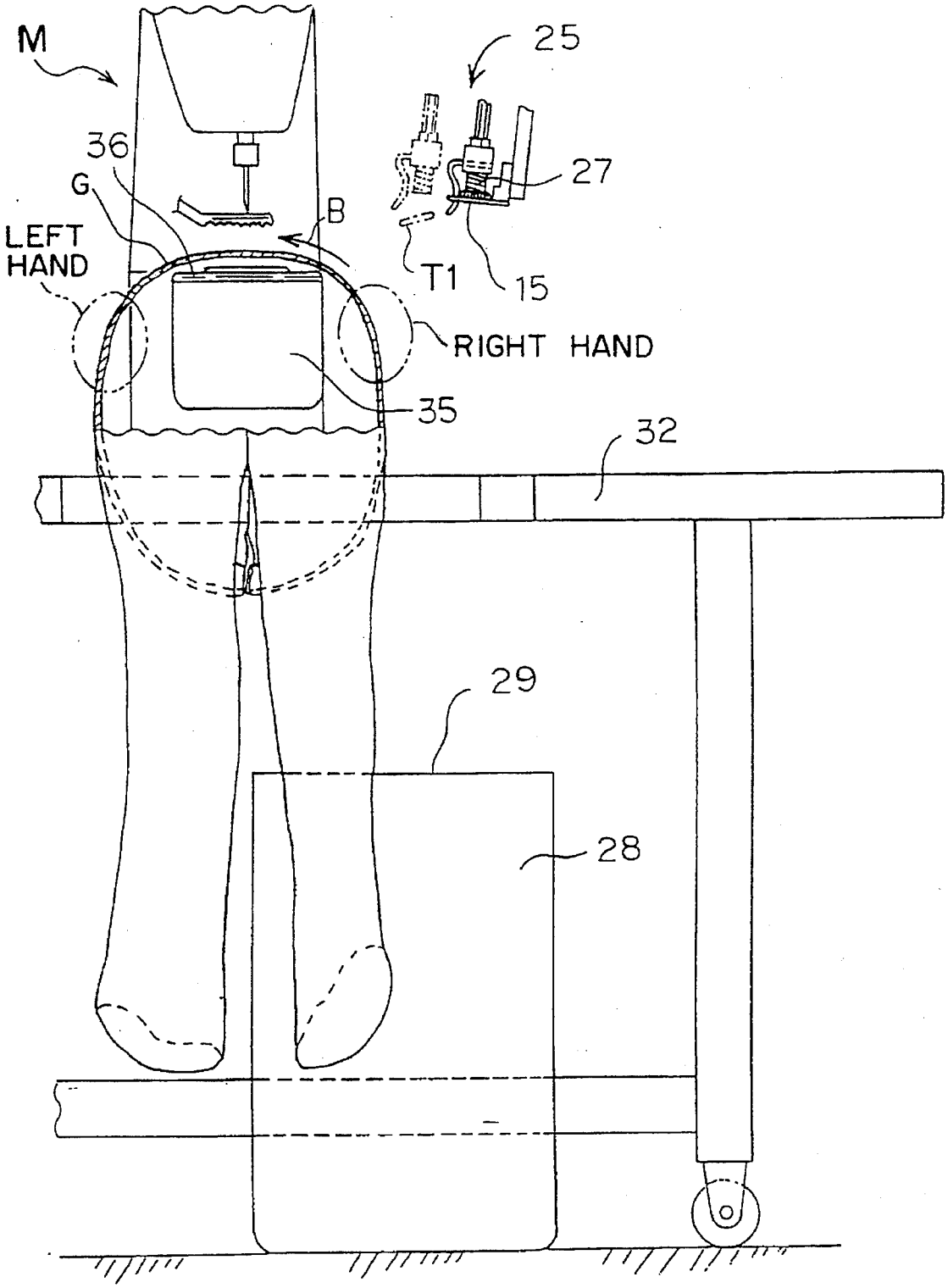
Fig. 15 PRIOR ART
FIG. 15 is an elevational view of the sewing machine of FIG. 14.
Figure 16:
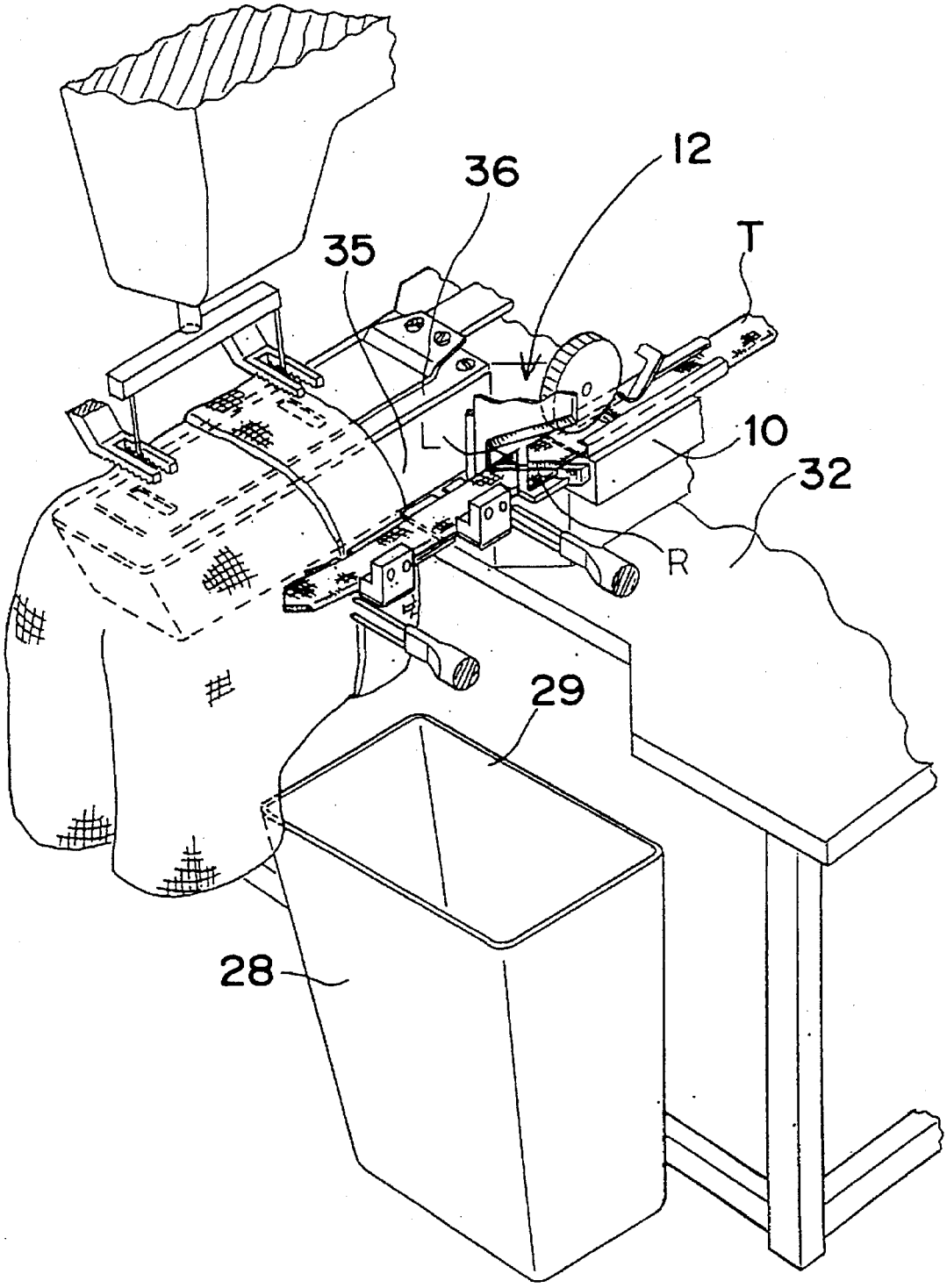
Fig. 16 PRIOR ART
FIG. 16 is a view similar to FIG. 14, but indicating the case where a length of tape is cut in the shape of "X".

The operation of the second tape waste collector C2 is explained in detail hereinafter with reference to a flow-chart shown in FIG. 13.

At step S11, the pulse motor 51 is activated to rotate the tape feed roller 11 so as to feed a length of tape T along the tape receiving plates 15*a* and 15*b*.

When the tape T is fed by a predetermined length appropriate to form a belt loop, the controller 50 controls the first cutter operating solenoid valve 52 to move the movable blade 12*a* downwardly so as to obliquely cut the tape T, as shown by a double-dotted chain line in FIG. 10, thereby accomplishing a first cutting (step S12). After the movable blade 12*a* has been moved upwardly, both of the movable and stationary blades 12*a* and 12*b* are caused to pivot about 55° horizontally in the counterclockwise direction, as viewed in FIG. 10, thereby taking the position shown by a solid line (step S13).

The compressed air is then blown out from the air nozzles 62 and 64 respectively located downstream and upstream of the tape cutter 12 towards the movable blade 12*a* and stationary blade 12*b*, and at the same time, the compressed air is introduced into the Venturi tube 71 to start a sucking operation (step S14).

Thereafter, the movable blade 12*a* is again moved downwardly to obliquely cut the tape T, thereby accomplishing a second cutting indicated by the solid line in FIG. 10 (step S15). At this time, the triangular cutting waste R produced on the right-hand side of the tape T is blown off to the right-hand side of the stationary blade 12*b* by the action of the compressed air from the air nozzle 62. This cutting waste R impinges on the guide plate 66 extending upwardly from the hopper 65 on the right-hand side thereof. On the other hand, the triangular cutting waste L produced on the left-hand side of the tape T is blown off to the left-hand side of the stationary blade 12*b* by the action of the compressed air from the air nozzle 64. This cutting waste L impinges on the guide plate 67 extending upwardly from the hopper 65 on the left-hand side thereof. In this way, both of the triangular cutting wastes R and L are positively introduced into the hopper 65.

These cutting wastes R and L are, upon entering the hopper 65, sucked into the bellows hose 70 by the Venturi tube 71 secured to the lower surface of the machine table 32. Thereafter, the cutting wastes R and L pass through the Venturi tube 71 and the bellows hose 72 and are eventually introduced into the waste box 73 disposed below the machine table 32 (step S16).

When a timer 58 electrically connected to the waste discharge solenoid valve 57 is up, the solenoid valve 57 is deenergized to stop blowing the compressed air (step 817).

In cutting the tape M into pieces of a predetermined length, the waste sucking operation is repeatedly carried out whenever the cutting wastes R and L are separated from the tape T.

As described hereinabove, when the tape T is cut in the shape of "X", the cutting wastes R and L are blown down on respective sides of the stationary blade 12*b* by the action of the compressed air from the air nozzles 62 and 64, respectively. Because the cutting wastes R and L are, after impinging on the guide plates 66 and 67, positively introduced into the hopper 65 and then into the waste box 73, no tape wastes scatter on the floor, thus eliminating sweeping which has hitherto been required upon completion of the sewing operation of belt loops.

Moreover, because all the elements constituting the second tape waste collector C2 are located so as not to hinder the operator in his sewing operation, the operator can devote himself to the sewing operation.

It is to be noted that although the sewing machine M includes various vertically movable elements other than the tape cutter 12, description of those having no connection with the tape waste collector assembly of the present invention is omitted here for brevity's sake. However, solenoid-operated air cylinders are generally employed for actuating such vertically movable elements.

Although the present invention has been filly described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A tape waste collector assembly for use with a belt loop sewing machine having cutting means for cutting a length of tape placed on tape receiving means into pieces of a predetermined length so that each of the pieces of tape can be sewn on a garment to form a belt loop, said tape waste collector assembly comprising:

an air source;

air blowing means pneumatically connected to said air source for blowing compressed air supplied from said air source towards the length of tape placed on the tape receiving means;

seam detecting means, disposed upstream of the cutting means with respect to a direction of travel of the length of tape, for detecting a seam in the length of tape;

tape waste collecting means for collecting tape wastes produced when the length of tape is cut by the cutting means; and control means for controlling the cutting means in response to a seam detection signal output from said seam detecting means, said control means also controlling said air blowing means and said tape waste collecting means for a predetermined period of time, when a seam is cut off from the length of tape, so that the tape wastes blown off by said air blowing means are collected by said tape waste collecting means.

2. The tape waste collector assembly according to claim 1, wherein said air blow means comprises an air pipe disposed downstream of said cutting means with respect to a direction of travel of the tape for blowing off a piece of tape having a seam.

3. The tape waste collector assembly according to claim 1, wherein said tape waste collecting means comprises a hose having opposite first and second ends with said first end disposed downstream of said cutting means with respect to a direction of travel of the tape, a waste box connected to said second end of said hose, and a negative pressure generating means for generating a negative pressure inside said hose to introduce the tape wastes into said hose and then into said waste box.

4. The tape waste collector assembly according to claim 3, wherein said negative pressure generating means comprises a Venturi tube mounted on an intermediate portion of said hose and pneumatically connected to said air source.

5. The tape waste collector assembly according to claim 1, wherein said air blow means comprises at least one air pipe disposed in the proximity of said cutting means for blowing off tape wastes produced when the length of tape is cut in the shape of "X" by said cutting means.

6. The tape waste collector assembly according to claim 1, wherein said tape waste collecting means comprises a hopper disposed below said cutting means, a hose having opposite first and second ends with said first end connected to said hopper, a waste box connected to said second end of said hose, and a negative pressure generating means for generating a negative pressure inside said hose to introduce the tape wastes into said hose and then into said waste box.

7. The tape waste collector assembly according to claim 6, wherein said negative pressure generating means comprises a Venturi tube mounted on an intermediate portion of said hose and pneumatically connected to said air source.

8. The tape waste collector assembly according to claim 1, wherein said air blow means comprises two air pipes disposed upstream and downstream of said cutting means with respect to a direction of travel of the tape, respectively, for blowing off on respective sides of said cutting means associated tape wastes produced when the length of tape is cut in the shape of "X" by said cutting means.

9. A tape waste collector assembly for use with a belt loop sewing machine having cutting means for cutting a length of tape placed on tape receiving means into pieces of a predetermined length so that each of the pieces of tape can be sewn on a garment to form a belt loop, said tape waste collector assembly comprising:

an air source;

air blowing means pneumatically connected to said air source for blowing compressed air supplied from said air source towards the length of tape placed on the tape receiving means;

tape waste collecting means for collecting tape wastes produced when the length of tape is cut by said cutting means, said tape waste collecting means including a hose having opposite first and second ends, said first end disposed downstream of said cutting means with respect to a direction of travel of said tape, a waste box connected to said second end of said hose, and negative pressure generating means for generating a negative pressure inside said hose to introduce the tape wastes into said hose and then into said waste box; and control means for controlling said air blowing means and said tape waste collecting means so that the tape wastes blown off by said air blowing means are collected by said tape waste collecting means.

10. The tape waste collector assembly according to claim 9, said negative pressure generating means comprising a Venturi tube mounted on an intermediate portion of said hose and pneumatically connected to said air source.

11. The tape waste collector assembly according to claim 9, in which said air blowing means comprises an air pipe disposed downstream of said cutting means with respect to the direction of travel of the tape for blowing off a piece of tape having a seam.

12. The tape waste collector assembly according to claim 9, in which said air blowing means comprises at least one air pipe disposed in proximity to said cutting means for blowing off tape wastes produced when the length of tape is cut in a shape of an "X" by said cutting means.

13. The tape waste collector assembly according to claim 9, in which said tape waste collecting means comprises a hopper disposed below said cutting means, said first end of said hose being connected to said hopper.

14. The tape waste collector assembly according to claim 13, in which said negative pressure generating means comprises a Venturi tube mounted on an intermediate portion of said hose and pneumatically connected to said air source.

15. A tape waste collector assembly for use with a belt loop sewing machine having cutting means for cutting a length of tape placed on tape receiving means into a shape of and "X" and into pieces of predetermined length so that each of the pieces of tape can be sewn on a garment to form a belt loop, said tape waste collector assembly comprising:

an air source;

air blowing means pneumatically connected to said air source for blowing compressed air supplied from said air source towards the length of tape placed on the tape receiving means, said air blowing means including two air pipes, one of said two air pipes positioned upstream and another of said two air pipes positioned downstream of said cutting means with respect to a direction of travel of the tape, for blowing on respective sides of said cutting means for blowing tape waste produced when the length of tape is cut in the shape of an "X" by said cutting means;

tape waste collecting means for collecting tape waste produced when the length of tape is cut by said cutting means; and control means for controlling said air blowing means and said tape waste collecting means so that the tape waste blown by said air blowing means are collected by said tape waste collecting means.

16. The tape waste collector assembly according to claim 15, in which said tape waste collecting means comprises a hose having opposite first and second ends, said first end disposed downstream of said cutting means with respect to the direction of travel of the tape, a waste box connected to said second end of said hose, and negative pressure generating means for generating a negative pressure in a side of said hose to introduce the tape wastes into said hose, and then into said waste box.

17. The tape waste collector assembly according to claim 16, in which said negative pressure generating means comprises a Venturi tube mounted onto an intermediate portion of said hose, and pneumatically connected to said air source.

18. The tape waste collector assembly according to claim 15, in which said tape waste collecting means comprises a hopper positioned below said cutting means, a hose having opposite first and second ends with said first end connected to said hopper, a waste box connected to said second end of said hose, and a negative pressure generating means for generating a negative pressure in a side of said hose to introduce the tape wastes into said hose and then into said waste box.

19. The tape waste collector assembly according to claim 17, wherein said negative pressure generating means comprises a Venturi tube mounted on an intermediate portion of said hose and pneumatically connected to said air source.

20. A tape waste collector assembly for use with a belt loop sewing machine having a cutter that cuts a length of tape placed on a tape receiver into pieces of a predetermined length so that each of the pieces of tape can be sewn on a garment to form a belt loop, said tape waste collector assembly comprising:

an air source;

an air blower pneumatically connected to said air source to blow compressed air supplied from said air source towards the length of tape placed on the tape receiver;

a seam detector that detects a seam in the length of tape, disposed upstream of the cutter with respect to a direction of travel of the length of tape;

a tape waste collector that collects tape wastes produced when the length of tape is cut by said cutter; and a controller that controls the cutter in response to a seam detection signal output from said seam detector, said controller also controlling, when a seam is cut off from the length of tape, said air blower and said tape waste collector for a predetermined period of time so that the tape wastes blown off by said air blower are collected by said tape waste collector.

* * * * *